US006056854A

United States Patent [19]

Woodrum

[11] Patent Number: 6,056,854

[45] Date of Patent: May 2, 2000

[54] PROCESS TO MAKE A WET-LAID ABSORBENT STRUCTURE

[75] Inventor: G. Thomas Woodrum, Chesapeake, Va.

[73] Assignee: BASF Corporation, Mount Olive, N.J.

[21] Appl. No.: 09/049,427

[22] Filed: Mar. 27, 1998

[51] Int. Cl.[7] ..... D21F 11/00; D21H 11/00

[52] U.S. Cl. ..... 162/141; 162/146; 162/164.1; 162/183

[58] Field of Search ..... 162/141, 146, 162/164.1, 183

[56] References Cited

U.S. PATENT DOCUMENTS

| | | | |
|---|---|---|---|
| 4,251,410 | 2/1981 | Danner et al. | 264/29.4 A |
| 4,914,066 | 4/1990 | Woodrum . | |
| 5,516,585 | 5/1996 | Young, Sr. . | |
| 5,597,873 | 1/1997 | Chambers . | |
| 5,607,550 | 3/1997 | Akers . | |
| 5,651,862 | 7/1997 | Anderson . | |

FOREIGN PATENT DOCUMENTS 0 359 615 A1 3/1990 European Pat. Off. .

*Primary Examiner*—Christopher A. Fiorilla
*Attorney, Agent, or Firm*—David T. Banchik

[57] ABSTRACT

A process to form a nonwoven, wet-laid, superabsorbent, polymer particle-impregnated fibrous structure on a commercial scale wet-forming machine having a head box, a forming section and a drying section, including adding SAP to water under and within 5 seconds of the SAP water contact, providing agitation of at least 4000 Reynolds units thereby dispersing ungelled SAP particles throughout the fiber furnish, delivering the furnish to a moving foraminous support, forming a wet laid web containing wetted SAP particles, draining of water from the moving wet web, and conveying the web to the dryer section, wherein the maximum elapsed time from the point where SAP is mixed with water to the time the web passes into the dryer section is less than 45 seconds.

13 Claims, No Drawings

PROCESS TO MAKE A WET-LAID ABSORBENT STRUCTURE

FIELD OF THE INVENTION

This invention relates to a continuous wet-laid process for forming a nonwoven structure containing fibers and the dried residue of particulate water insoluble, water-swellable, superabsorbent polymer (SAP), (hereinafter called a composite). The wet-lay process is similar to a paper process. The composite is useful in absorbent hygiene products such as diapers, incontinence pads, sanitary napkins, tampons, in filtration devices, and in wiping materials for mopping up spills of fluids. A wet-laid nonwoven fabric is a fabric comprising fibers which have been deposited from an aqueous suspension onto a moving foraminous support.

BACKGROUND OF THE INVENTION

Fibrous, nonwoven, superabsorbent, polymer-impregnated structures are known. See generally, U.S. Pat. Nos. 5,167,764, 5,607,550, 5,516,585. European Publication No. 437,816 discloses a wet laid process for incorporating superabsorbent which entails forming a gel on mixing of the SAP particles and fibers in a slurry. The amount of SAP contained in the webs taught is up to 60% of the total weight of the web. The particular superabsorbent particles used in the process taught in EP 437,816 yield a web which exhibits a characteristic absorbency under load (AUL). Higher AUL has been achieved for SAP more recently, however the use of these higher AUL SAPS in a continuous large-scale wet lay process presents serious difficulties. Attempting to use a commercial wet lay process in light of the teachings of the state of the art will present serious problems for example if fine particle size SAP (100 micron or less) or SAP particles which are surface crosslinked are attempted. The small particle size (less than 200 micron ) SAP or surface crosslinked SAP or particle range 200 to 850 micron can form a gel and result in a non-uniform web and a web which cannot be dried by practical means.

Alternatives to the gellation problem include EP-A-359615 which discloses a method for the manufacture of a superabsorbent fibrous structure in which a dry solid absorbent is applied directly to a wet-laid web of cellulosic fibers prior to drying the wet web.

EP-A-273075 discloses a high water-absorbency paper made by sheeting a mixture of wood pulp fiber, water-soluble resin and high water-absorbency resin.

Absorbent products such as diapers which include particles of a superabsorbent polymer such as crosslinked sodium polyacrlate disposed between layers of wood pulp are known for example from EP-A-257951.

The use of fibers of water-swellable water-insoluble superabsorbent, polymer is disclosed in U.S. Pat. No. 5,607,550, wherein it is taught that incorporation of superabsorbent, polymers in particulate form in the fiber web have significant disadvantages in many respects. The prior art teaches that superabsorbent, polymer particles are less securely retained and with less uniform dispersion of superabsorbent particles as opposed to the dispersion of the fibers of SAP. It is also taught conventionally that with superabsorbent, polymer particle-impregnated structures, the particles are loosely attached to the fibrous structure of the nonwoven fabric and attrition or loss is evident.

In order to provide sufficient absorbency performance for utilization in state-of-the-art absorbent articles, it has been found that a minimum 0.3 psi AUL of 30 for the SAP is needed and desiredly the percent loading of superabsorbent in a fibrous web needs to be at least about 50% by weight. However, loadings of SAP particles in a fiber structure (such as above about 80% SAP particles on the total weight of the web) have insufficient strength for the wet web to convey through the wet-lay forming process.

Whereas the cost associated with forming fibers of superabsorbent, polymer is inherently higher than that of the particulate SAP, it would be desirable to overcome the aforementioned drawbacks in the use of particles of SAP. Composite structures of fibers impregnated with superabsorbent, polymer particles could greatly reduce the manufacturing cost of end use products such as those aforementioned.

Co-pending U.S. Patent application Ser. Nos. 09/026,002 and 09/025,384 disclose process to make SAP/fiber composites by the wet laid nonwoven method and utilize added salt in the furnish to retard the gellation of the SAP. The presence of salt gives rise to inefficiencies in the process as well as environmental compliance issues. Therefore it would be desirable to eliminate salt addition to the furnish. Accordingly, there is a need for an environmentally friendly process to make SAP/fiber composite on commercial scale wet-lay equipment and at sufficient line speeds to be of commercial economical importance. An improved process for forming such a composite has been found which yields a uniform web which can be dried using conventional drying equipment. The web also exhibits advanced absorbency performance.

SUMMARY OF THE INVENTION

In accordance with the invention there is provided a process to form a nonwoven, wet-laid, superabsorbent, polymer particle-impregnated fibrous structure on a commercial scale wet-forming machine having a head box, a forming section and a drying section, the process comprising adding SAP to water and within 5 seconds of the SAP water contact, providing agitation of at least 4000 Reynolds units thereby dispersing ungelled SAP particles throughout the fiber furnish, delivering the furnish to a moving foraminous support, forming a wet laid web containing wetted SAP particles, draining of water from the moving wet web, and conveying the web to the dryer section, wherein the maximum elapsed time from the point where SAP is mixed with water to the time the web passes into the dryer section is 45 seconds or less.

DETAILED DESCRIPTION OF THE INVENTION

All percentages specified herein are weight percentages. Specifically, the process forms a structure which comprises from 50% to 80% of SAP, and 20% to 50% fibers. The preferred fibers are a combination of wood pulp fibers and cellulose acetate fibers. The aqueous furnish comprises normally available water such as well water, or treated municipal water. Salt addition is obviated. The furnish is passed over a moving foraminous support, such as a Fourdrinier wire, and a wet web structure is formed. Time is critical in the present process. The wet web structure is conveyed to an in-line dryer within the maximum elapsed time of 45 seconds or less from the time the SAP and water are joined. This time can be controlled by the adjusting the speed of the moving foraminous support and dryers conveyors.

The SAP polymer particle-impregnated structure (web) must enter the dryer before substantial gel formation. Substantial gel formation prior to entry of the web into the dryer section was found to cause the web to remain wet after drying, and impossible to process the web on a practical basis. Since it is financially ruinous to observe the failure of a wet laid web by gel formation on a commercial machine, a simple test has been found to assess whether the SAP will generate a failure on the process. The time at which an SAP undergoes substantial gel formation can be separately approximated. The approximate gel time test is assessed in the following manner: 1.0 grams of SAP material is pre weighed. 0.2 L of water are placed in a 250 ml beaker measuring 3 in. by 4 in. Agitation is achieved by a magnetic stirrer at 700 rpm which generates a vortex reaching down to the stirrer. Time zero is marked when the SAP is introduced to the stirring water. The approximate gel time is measured from the point of addition until the vortex closes to a smooth surface. This is an indication of the approximate gel time of the SAP and the critical process parameter of elapsed time expected. The elapsed time on the wet lay forming apparatus from wetting of SAP to entry of the web into the dryer section must not be greater than the time observed using the approximate gel time test.

The wet-laid, superabsorbent, polymer particle-impregnated structure designed for a hygienic articles preferably, on a dry weight basis, comprises about 50% to about 80% water insoluble, water swellable polymer (SAP) and about 20% to about 50% fibers (fibrous portion). The fibrous portion of the web in one preferred embodiment comprises 5% to 50% cellulose acetate fibers and 50% to 95% pulp fibers. More preferably the fibrous portion comprises 10% to 50% cellulose acetate fibers and 50% to 90% wood pulp fibers. Still more preferredly the fibrous portion comprises 10% to 40% cellulose acetate fibers and 60% to 90% wood pulp fibers. Most preferredly, the fibrous portion comprises 5% to 20% cellulose acetate fibers and 80% to 95% wood pulp fibers for absorbent articles for personal hygiene applications.

The SAP/fiber web is produced using an exemplary apparatus known in the art is an inclined wire forming machine. In a typical embodiment of the process the line is started by supplying the head box with fiber slurry and introducing the SAP continuously to the head box while discharging the contents of the head box to the inclined wire. Sap must be wetted with water with agitation of a minimum of 4000 Reynolds units and the agitation must be achieved within 5 seconds of the water impingement to the SAP. Reynolds number calculations are found in Perry's Chemical Engineers Handbook, 6th Ed. 1991.

Preferably agitation of the specified minimum Reynolds number is applied in 4 seconds or less. This agitation can be provided by circulating the slurry within the head box. Agitation outside the head box can be by way of what is referred to in the art as a hootenany. The principle of a hootenany utilizes a fluid stream flow to generate an eductive or negative force which can be utilized to add a second stream. This technique is applied for powder type feeds into a fluid stream.

The rate of SAP supplied to the head box is controlled in relation with the rate of fiber furnish added to the head box to yield the desired SAP/fiber weight ratio. For a machine making webs of 1.7 meters width at a basis weight of 150 gsm, and for a 60 wt. % SAP level in the sheet, the consumption of SAP will typically be about 204±5 lbs./hr.

The basis weight of the web is controlled by the speed of the inclined wire and the solids level in the furnish. The basis weight of the dried composite ranges typically from 100 grams per square meter to about 500 grams per square meter (gsm), preferably 100 to 400 gsm. Webs of 100 to 200 are desirable for disposable diapers.

A preferred embodiment of the process is the use of an inline mixer for SAP and water conveyed to the head box through a hootenany.

The residence of the furnish in the head box is controlled by the volume of the head box and the flow rate of the furnish onto the moving wire. For a line speed of 33 ft./min. and basis weight from 100 to 200 gsm, a volume of 8000 gallons per hour of furnish feed to make a 1.7 meter wide web is sufficient to achieve the critical elapsed time parameter maximum of 45 seconds. In order to increase line speeds, the liquid feeds are increased proportionately.

When using an SAP which is surface crosslinked with the maximum elapsed time may be less than 45 seconds. For example, a SAP having a particle size range of 200 to 850 microns, such as made by the process of U.S. Pat. No. 5,597,873 using Kymene® 736 surface crosslinker at 1.2 wt. %, the approximate gel time test indicates that in 54 seconds the SAP will gel. This SAP can therefore be used in the process of the present invention.

It has been found that the particle size of the SAP impacts the time of substantial gellation. In order to operate a commercial wet lay machine using a SAP having a particle size of less than 200 microns, especially if the SAP has been recovered from a surface crosslinked primary SAP, the elapsed time from wetting to dryer should be less than about 10±3 seconds. Line speed would need to be approximately 66 feet per minute to maintain an elapsed time limit of under 10 seconds±3 seconds for a web of 100 to 200 gsm.

The web is transferred from the inclined wire to a conveyor optionally equipped with vacuum suction ports to further remove processing water. The general process, aside from the critical modifications embodied in the present invention is described in "Manual of Nonwovens" by R. Krcma (4th Edition 1974, Textile Trade Press, Manchester) at pages 222 to 226. In general, the fiber and particles are wet-laid in a process similar to a conventional papermaking process. The fiber and particles in the aqueous suspension are continuously deposited on the moving foraminous support. The wood pulp fibers may need to be refined, but this is not essential in the practice of the invention. It is preferred to mix the superabsorbent polymer particles into the slurry after refining-has been completed.

The furnish can be poured or deposited at a controlled rate onto a substantially horizontal mesh screen, or the furnish may be deposited on an inclined mesh screen traveling upwards through the slurry. An inclined wire is preferred. For best results in utilizing available dryer capacity, the furnish should be deposited on a mesh screen which is at the surface of a suction drum. The mesh size of the screen should be such as to allow easy drainage of water but to retain the solids; the most suitable mesh size will generally be in the range 0.2 to 1.5 mm. The mesh can be of metal wire or synthetic polymer, for example polyester filament. The basis weight of the resulting dried web having no more than 0.5% moisture content is preferably from 100 to 500 g/m$^2$ (gsm), more preferably from 100 to 400 gsm, and most preferably webs of 150±25 and 250±25 gsm are made and utilized in a multi-layered absorbent component in a disposable diaper.

The process of the present invention enables the use of conventional drying means in-line to the web forming process. The wet web is therefore capable by the process of the present invention to be brought to uniform and substantial dryness using suitable techniques generally employed in papermaking including passage of the web around a heated drum, passage between a series of heated rolls, or on a flat bed, a through air dryer. Such drying means can include one or more than one single means, for example, a rotary/thru air dryer and a heated drum dryer, or an infrared heating source, or hot air blowers, or microwave emitting source, and the like, all which are known and used in wet-laid web drying processes. The most preferred drying method is combination of heated drum and through-air dryers which is readily practiced in the art.

All processing waters except that which is driven off in the dryer exhaust, are captured and recycled to the process; these waters are collected in what is identified as the "white water" tank. Web basis weight is controlled by regulating the concentration of superabosrbent polymer and fiber components in the head box. A premixture of SAP and fiber slurry into a large tank followed by feeding this mixture to the forming line is not possible in the present invention. The headbox is of a size such that the SAP is resident in this container for only a matter of several seconds. The turnover of SAP in the headbox is high enough so that the total time elapsed from wetting of SAP until the formed web reaches the dryer will be less than or equal to 45 seconds. Preferably the elapsed time from wetting to dryer is less than or equal to about 30±3 seconds. Most preferably the lapsed time from wetting of SAP until the formed web reaches the dryer section is less than or equal to 25 seconds.

Absorbency Under Load (AUL) for particulate SAP is defined as follows:

AUL is a measure of the amount of saline (0.9% wt/% NaCl aqueous solution) absorbed by the SAP polymer while a predetermined amount of weight is applied to the polymer gel and indicates the effectiveness of the polymer's absorbency in relation to actual use conditions. Absorbency under load is measured using a plastic petri dish with elevating rods and a 1.241" OD×0.998" ID×1.316" long plexiglass tube with a wire net (100 U.S. mesh) at the bottom of the tube. The particle size of the test samples is controlled between 30 to 50 mesh, (passing through a 30 mesh and retained on a 50 mesh).

A test sample, 0.160±0.01 g is weighed out and recorded as $S_1$. The sample is placed in the plastic tube and is spread evenly over the wire net. A specified weight(e.g. a 100 g, 200 g or 300 g weight yielding 0.3 psi, 0.6 psi and 0.9 psi load, respectively) and a disc are placed on the sample. The assembly (polymer sample, tube, disc and weight) is weighed and recorded as $W_1$. The assembly is then placed in a petn dish containing 40 ml 0.9% saline aqueous solution. After one hour of absorption, the assembly is removed from petri dish and excess saline blotted from the bottom. The assembly is weighed again and this value recorded as $W_2$. Absorbency under load (AUL) is equal to $(W_2-W_1)/S_1$ and is express in g/g.

Absorbency Under Load (AUL/(for web sample)

This test is designed to determine the absorbency under load of a web containing a mixture of superabsorbent polymer and fibrous materials. This is a measure of saline (0.9% wt/% NaCl aqueous) solution absorbed by the web while a predetermined amount of weight is applied to the web and indicates the effectiveness of the web's absorbency in a diaper system under the weight of a baby. Absorbency under load is measured by cutting a 2 in. diameter circular sample with a die cutter. The sample is oven dried for 2 hours and then weighed to ±0.1 grams. Prior to testing the sample is cooled in a controlled environment (70° C., 50% RH). The sample holder is then dried with a hand-held heating blow-dryer to complete dryness. The sample holder has small feet on the bottom to insure a clearance between the bottom of a saline liquid reservoir and the holder. The volume of saline solution to be added to the liquid reservoir is determined by adding a measured amount of saline solution to the reservoir until the liquid level rises to the top of the perforated plate(s) of the sample holder(s). This volume of saline solution is recorded as X. The volume of the saline to be added to the reservoir is X+120 mls. The circular web sample is placed top side down, inside the holder. The total weight of the sample in it's holder is recorded as the dry weight. A weight (providing load of 0.5 psi) is placed on top of the web sample. The reservoir is filled with X+120 mls. of 0.9% saline solution at a temperature of 23±1° C. Simultaneously the sample holder(s) is placed into the solution. After ten minutes of swelling, the sample holder(s) are removed from the reservoir and allowed to drip approximately 60 seconds. The weight is removed. The weight of the wet sample is re-weighed in the sample holder (wet weight). Calculations:

absorbed weight=(total weight of wet sample and holder) minus (total weight of dry sample and holder)

AUL (g/g)=absorbed weight divided by oven dried weight of sample

Materials of Web Construction

The fibers used may be filament or staple or a combination of a minor amount of filament and a major amount of staple, or staple fibers of varying lengths. The essential fibers in the web are cellulose acetate (CA) and wood pulp. Optional man-made fibers can be included but are not critical. Polyolefin fibers, polyester fibers and bicomponent fibers could be included. Preferably, all of the fibers used are CA and Pulp staple fibers, generally of length from 1 to 100 mm. In a preferred embodiment, a minor amount (about 20%–30% of the fibrous portion) is polyester fiber (type 103 sold under the TREVIRA® trademark), and from about 2 to 10% of the fibrous portion is made of bicomponent fibers sold under the type 105 Celbond® trademark of TREVIRA. The staple fibers are preferably of 10 to 50 mm in length. The greater the length, the greater the strength of the wet web structure up to a point where greater fiber length may adversely affect processing of the furnish, material cost, and web uniformity. Cellulose acetate staple is usually available in lengths of 2 to 50 mm. The more preferred lengths for cellulose acetate are from 0.25 to 0.75 inch (8 to 19 mm), and most preferred are lengths of about 0.5 in. (=12 mm). Cellulose acetate staple is commercially available from Celanese Acetate, Charlotte, N.C. The denier per filament (dpf) for the cellulose acetate fiber is not critical. Preferably cellulose acetate having 1.8 dpf and 12 mm length (0.5 inch) is used. Longer lengths could be used but at small denier, fiber entanglement can lead to less uniformity in the web.

Wood pulp fluff of typical length of about 8 mm is used in the wet laid nonvoven industry and is also suitable in the practice of the process. Wood pulp fluff fibers can be obtained from well-known chemical processes such as the kraft and sulfite processes. Suitable starting materials for these processes include hardwood and softwood species, such a alder, pine, douglas fir, spruce and hemlock. Wood pulp fibers can also be obtained from mechanical processes, such as ground wood, refiner mechanical, thermomechanical, chemi-mechanical, and chemi-thermomechanical pulp processes. However, to the extent such processes produce fiber bundles as opposed to individually separated fibers or individual fibers, they are less preferred. However, treating fiber bundles is not within the scope of the present disclosure. Recycled or secondary wood pulp fibers and bleached and unbleached wood pulp fibers can also be used. Details of the production of wood pulp fibers are well-known to those skilled in the art. These fibers are commercially available from sources including Weyerhaeuser Company, Buckeye Cellulose, and Rayonier.

The superabsorbent-polymers in particulate form as specified above generally fall into three classes, namely, starch graft crosslinked copolymers, crosslinked carboxymethylcellulose derivatives, and hydrophilic polyacrylates. Examples of such absorbent polymers are hydrolyzed starch-acrylonitrile graft copolymer, a neutralized starch-acrylic acid graft copolymer, a saponified acrylic acid ester-vinyl acetate copolymer, a hydrolyzed acrylonitrile/carboxylate copolymer or acrylamide copolymer, a partially neutralized self-crosslinking polyacrylic acid, a partially neutralized, lightly crosslinked polyacrylic acid polymer, carboxylated cellulose, a neutralized crosslinked isobutylene-maleic anhydride copolymer, and the like.

The superabsorbent polymer particles need not be but preferably have at least a portion of their surface which is crosslinked. The preferred SAP are surface crosslinked polyacrylic acid polymers as taught in U.S. Pat. Nos. 4,507,438, 4,541,871, 4,666,983, 5,002,986, 5140,076, 5,164,459, 5,229,466, 5,322,896, 5,597,873, and EP 509,708.

The fiber/SAP/solids content of the slurry referred to below, deposited on the foraminous support (wire) is generally in the range 0.1 to 50 g/liter solids content, preferably 0.2 to 20 g/liter, and more preferably 0.2 to 5 g/liter. Depending on the feed rate of furnish on the wire and the speed of the line, a solids content in the area of 0.2 to 2 g/liter can be run and conditions adjusted so that a basis weight of from 100 to 500 gsm can be achieved on typical conventional wet-laying machinery. A portion of the water content of the slurry is drained from the deposited fiber/SAP layer while it is supported on the mesh screen, preferably with the aid of suction applied below the screen. Optional compression rolls can be used but are not essential and may be desired when dryer capacity is limited and particularly when making higher basis weight webs (350 gsm and above). The solids content of the wet-laid web as it is taken off the mesh screen is preferably at least 5% and most preferably at least 10% by weight, and it is generally not more than 30% and usually not more than 20% by weight prior to treatment with water.

The wet-laid nonwoven structure can optionally include dispersed particles such as silica, a zeolite or a mineral clay, such as kaolin or bentonite. Such particles, which preferably are not used at more than 10% by weight of the nonwoven fabric, can be added to the furnish as described in EP-A-437816 or incorporated in the superabsorbent particles as described in WO-A-92/19799.

EXAMPLES

Example 1

Using a commercial wet-lay web former such as available under the Bruderhaus® trademark, the following is made:

Superabsorbent, surface crosslinked SAP with a particle size range of 200 to 850 (Sanwet IM-7200, ex Clariant), was used in this example. The SAP was wetted with the aqueous slurry and within 5 seconds was agitated by the fluid velocities of the stock and white water feeds and baffling inside the headbox adjusted in order to provide a minimum 4000 Reynolds number to be achieved. The aqueous slurry as it left the head box comprised about 2.5 grams per liter of solids, with solids comprising 60% of the SAP particles and 40% of the fiber portion. The fiber portion consisted of 75% CA fiber and 25% of bicomponent fiber (CELLBOND® TYPE 105, ex Trevira). As the SAP was added to the slurry, the combined SAP-slurry was deposited onto the moving inclined wire at a flow rate of 8,000 gallons per hour to form a 1.7 meter wide moving wet web. The web was advanced at the rate of 10 meters/min. and was passed to the dryer zone with an elapsed time of 15–20 seconds from the time of wetting until the time the web passed into the entry point of the dryer zone. The web was uniform in dispersion of SAP and dried uniformly and could be wound up as it emerged from the drying section. The web had a nominal basis weight of 150 gsm. The AUL for the web was 16 g/g, corresponding to AUL per unit SAP of 25 g/g.

I claim:

1. A process for the continuous production of a nonwoven, SAP particle-impregnated fibrous structure on a wet-lay nonwoven apparatus, said apparatus comprising a head box, a moving foraminous support and a drying section, the process comprising:

adding SAP to a fiber furnish and within 5 seconds of the SAP-fiber furnish contact, providing agitation of at least 4000 Reynolds units thereby dispersing ungelled SAP particles in the fiber furnish, delivering said furnish to said moving foraminous support, forming a wet laid web containing wetted SAP particles, draining water from the moving wet web, and conveying the web to said drying section, wherein the maximum elapsed time from the point where SAP contacts water to the time the web passes into the dryer section is less than or equal to 45 seconds.

2. The process of claim 1 wherein said superabsorbent is a crosslinked copolymer of 50 to 99.99% by weight ethylenically unsaturated carboxylic monomer and optional copolymerisable ethylenically unsaturated monomer.

3. The process according to claim 1 wherein said furnish as delivered to said foraminous support has a solids content of from 0.1 to 50 grams per liter.

4. The process according to claim 3, wherein said furnish as delivered to said foraminous support has a solids content, of from 0.1 to 20 grams per liter.

5. The process according to claim 4, wherein said furnish as delivered to said foraminous support has a solids content, of from 0.1 to about 5 grams per liter.

6. The process of claim 1 wherein said fibrous structure contains from 50% to 80% of said SAP and 20% to 50% of said fiber, and wherein said structure has a basis weight of from 100 to 500 gsm.

7. The process of claim 6 wherein said structure has a basis weight of from 100 to 400 gsm.

8. The process of claim 1 wherein said structure contains cellulose acetate fibers having a length of from 0.25 to 0.5 inches and wood pulp fibers having a length of from 0.25 to 0.75 inches.

9. The process of claim 1 wherein said fibers comprise, cellulose acetate, wood pulp fibers and bicomponent fibers.

10. The process of claim 1 wherein said SAP is surface crosslinked.

11. The process of claim 1 wherein said maximum elapsed time from the point where SAP contacts water to the time the web passes into the dryer section is less than or equal to 30 seconds ±3 seconds.

12. The process of claim 1 wherein said maximum elapsed time from the point where SAP contacts water to the time the web passes into the dryer section is less than or equal to 25 seconds.

13. A process for the continuous production of a nonwoven, SAP particle-impregnated fibrous structure on a wet-lay nonwoven apparatus, said apparatus comprising a head box, a moving foraminous support and a drying section, the process comprising:

adding SAP to water and within 5 seconds of the SAP-water contact, combining the SAP and water with a fiber furnish and providing agitation of at least 4000 Reynolds units thereby dispersing ungelled SAP particles in the fiber furnish, delivering said furnish to said moving foraminous support, forming a wet laid web containing wetted SAP particles, draining water from the moving wet web, and conveying the web to said drying section, wherein the maximum elapsed time from the point where SAP contacts water to the time the web passes into the dryer section is less than or equal to 45 seconds.

* * * * *